US006446416B1

(12) United States Patent
Kuhn et al.

(10) Patent No.: US 6,446,416 B1
(45) Date of Patent: Sep. 10, 2002

(54) VERTICAL INSERT BUCKET

(75) Inventors: John W. Kuhn, Taylor Mill; Kenneth J. Roe, Independence, both of KY (US)

(73) Assignee: R. A. Jones & Co. Inc., Covington, KY (US)

( * ) Notice: Subject to any disclaimer, the term of this patent is extended or adjusted under 35 U.S.C. 154(b) by 0 days.

(21) Appl. No.: 09/432,991

(22) Filed: Nov. 3, 1999

(51) Int. Cl.[7] ..... B65B 35/56; B65B 61/20

(52) U.S. Cl. ..... 53/445; 53/446; 53/474; 53/155; 53/544; 53/238; 53/252; 198/802

(58) Field of Search ..... 53/443, 445, 446, 53/474, 155, 154, 157, 544, 237, 238, 240, 247, 252, 251; 198/468.01, 468.2, 377.01, 373, 379, 397.06, 701, 703, 705, 713, 715, 802

(56) References Cited

U.S. PATENT DOCUMENTS 2,164,077 A * 6/1939 Owen ..... 53/157
3,303,921 A * 2/1967 Gore ..... 198/802
3,608,701 A * 9/1971 Dieter ..... 53/251
3,768,229 A * 10/1973 Bross et al. ..... 53/252
4,398,383 A * 8/1983 Prakken ..... 53/247
5,185,984 A * 2/1993 Tisma ..... 53/252
5,987,859 A * 11/1999 Dreger ..... 53/544
6,199,680 B1 * 3/2001 Sakai et al. ..... 53/446
6,205,749 B1 * 3/2001 Crawford ..... 53/446

* cited by examiner

*Primary Examiner*—Stephen F. Gerrity
(74) *Attorney, Agent, or Firm*—Wood, Herron, & Evans LLP

(57) ABSTRACT

A bucket on a bucket conveyor has a movable member or wall movable to a laid down position for receiving a horizontally disposed item. The member or wall is moved to reorient the item into an upright position for loading into a carton with another item later introduced into the bucket on another side of the movable member from the first item. Multiple items, inserts and/or multiple products can be handled. Methods and apparatus are provided.

20 Claims, 6 Drawing Sheets

VERTICAL INSERT BUCKET

FIELD OF THE INVENTION

This invention relates to cartoning apparatus and more particularly to apparatus and methods for orienting items in a conveyor bucket for intermittent or continuous cartoning. This invention thus also relates to the insertion of inserts, along with products, into cartons.

BACKGROUND OF THE INVENTION

It is known to load conveyor buckets with one or more items and to push such items from the buckets into a carton, either continuously or intermittently. The orientation of the items, whether they are products, inserts, partitions or other items, in the buckets is a concern in any cartoning process or apparatus. The proper or desired item orientation drives the parameters and structure of the processes and apparatus used to fill the buckets, as well as the actual bucket design. These processes and apparatus can limit the throughput speeds at which cartoning can be accomplished. They can also restrict the efficiencies of the overall loading and cartoning operation.

Thus, the industry has devoted attention to feeding items, whether products, inserts or other things, into buckets in the appropriate attitude or orientation for loading from the bucket into a carton. Feeders are designed for introducing items to the buckets in proper orientation since further handling is typically limited to transferring the items into a carton. Thus, the feeders are generally of particular design as a function of the item and its desired feeding orientation, as well as a function of the bucket design for receiving the item, and the dynamic motion of the bucket as it is supplied with the item (i.e. in continuous or intermittent motion).

In a specific example, it is known to combine a product and an insert in a product bucket and thereafter push them into a carton. A series of buckets on a bucket conveyor are used to receive the products and inserts in a continuous operation, for example, and to carry them to a loading station. Typically, and for example only, a product such as a medicine or personal care product is combined with a multiple leaf informational insert and these are pushed into a carton for packaging. Such inserts may take the form of a rectilinear leaflet or brochure of single or multiple sheets, a folded brochure, a booklet or a promotional or related product, such as a packet of rubber gloves, applicators, or the like.

In the past, such buckets were comprised of upstanding forward and rearward walls and a fixed intermediate wall, closely proximate the rear bucket wall to define a slot-like area for receiving the insert. An insert feeder stripped the insert from a magazine feed and moved it toward the bucket from above, orienting it in a vertical position and dropping or inserting it into the mouth of the moving slot-like area as the bucket appeared under the discharge position of the feeder. When used in an intermittent motion apparatus, the bucket and target slot stopped under the feeder discharge. When used in a continuous motion apparatus, the insert is introduced into the moving slot.

In either case, the slot mouth could be hard to hit and required close attention to indexing. While the slot could be made wider to provide a larger transverse target in the machine direction, making the slot easier to "hit" with the insert, this unduly lengthened the bucket, and did not position the insert as close to the product as desired for cartoning.

Accordingly, it is appreciated that the slot-like area had a relatively narrow transverse mouth which was a hard target for the vertical feeder to hit, particularly at the continuous bucket speeds typically desired in such a cartoning operation. Even where the operation was intermittent and the bucket stopped for loading, the narrow mouth required a more precise feed operation for the insert.

This also required the use of a vertical feeder which introduced more complexity into the feeding of inserts, more easily accomplished in a horizontal operation. Yet the horizontal feeding of an insert would bridge the mouth of the slot-like insert receiving area of the bucket and could not be handled.

Moreover, once a first insert was introduced into the slot-like area in the bucket, it was very difficult, if not impossible, to introduce a second insert into the same area when two or more separate inserts were desired. The second vertically moving insert would hit the first, resulting in erratic if not impossible feeding.

Accordingly, it has been one objective of the invention to provide improved methods and apparatus for positionally orienting items for cartoning.

Another objective of the invention has been to provide methods and apparatus for orienting items fed to a conveyor from feeders feeding the items in a position different from that required of the item on the conveyor for cartoning.

It has been a further objective of this invention to provide an improved method for orienting an item in an upright or generally vertical position in a product bucket.

A further objective of the invention has been to provide improved apparatus for handling products and inserts for packaging.

A further objective of the invention has been to provide improved methods and apparatus for combining products and inserts in a product bucket for cartoning.

A further objective of the invention has been to provide improved methods and apparatus for producing vertically oriented inserts in product buckets while using horizontal insert transfers or feeders to the buckets.

SUMMARY OF THE INVENTION

To these ends, the invention contemplates in a preferred embodiment an improved bucket and method for combining one or more items in a bucket with one or more other items where one or more of the items is reoriented after its deposit in the bucket.

In particular, in a preferred embodiment of the invention, an insert is combined with a product where the insert is oriented in a generally upright attitude, even though first fed to the bucket in a generally laid down or horizontal attitude. This is accomplished by the us of a movable member in the bucket, preferably between its forward and rearward walls, although it could be used with a bucket in any configuration. An insert is introduced into the bucket in a laid-down, inclined or generally horizontal orientation. The movable member is then activated to engage and move the insert into or toward generally upright orientation. In a preferred embodiment, the insert is lifted in an upright attitude. Thereafter, product is loaded into the bucket and both product and upright insert are pushed laterally into a carton. One or more products in the bucket can be combined with one or more inserts in the bucket for cartoning. Where two or more inserts are desired, additional insert feeders are used to deposit additional inserts in the bucket before the movable member is operated to orient the inserts into or toward a generally upright orientation.

In a preferred embodiment, the movable member is a pivoted wall which is rotated to lift the inserts into an upright position. In so moving, the pivoted walls forms a narrow insert pocket with a wall of the bucket. Product is then loaded between the now upright movable wall and another bucket wall.

In this configuration, and as a more detailed aspect of this embodiment, an extended end of the movable wall, once the wall is erected, is used to pick off a product from a product infeed.

The pivoted wall is preferably spring loaded into its upright configuration. A cam beneath the conveyor carrying the buckets is engaged by a cam follower operably attached to the pivoted wall. The cam then pivots the wall down toward the floor of the bucket as the bucket moves over the cam so horizontally oriented inserts can be laid in the bucket. Thereafter, the cam gradually releases the follower and the spring-loaded wall rotates to its erected position, gently lifting or rotating the inserts to vertical or upright positions, depending on cam declination and bucket speed in the machine direction.

When more than one insert is desired, multiple inserts are laid into the bucket before the wall is pivoted.

Of course, the movable wall can be spring loaded to the down position and cammed upwardly. Alternately, dual or positive cams can be used to control wall motion in both directions, or any other wall moving apparatus, device or control can be used consistent with the invention.

The pivoted wall can be provided with slots for pass through of sensing beams when no insert has been deposited, to prevent false sensing for control and confirmation purposes. When no insert is deposited, there is no beam reflection. When an insert is laid on the wall, it reflects the beam indicating an insert is in place.

In this way, horizontal or inclined inserts can be fed to the buckets where they lay until the movable wall lifts them upright. The benefits of final vertical insert orientation are obtained but without the need to use more complex vertical feeders to produce upright inserts in the buckets.

This also facilitates positive insert feeds at high speeds of present day cartoners. The target for the insert is now the wide bucket floor between its end walls as opposed to prior systems presenting only narrow-mouthed transverse channels or slots for vertical inserts. The so-called insert "slot" is formed only after the insert is introduced to the bucket. The insert "target" is much wider as it is the target duration under the discharge of the insert feeder. Tolerances are expanded and faster speeds are clearly much more reachable. Also, loading two inserts is very easy whereas known past systems render dual insert feeding very difficult if not impossible.

In a broader aspect of the invention, the movable wall can be used to reposition or orient either products or inserts in a bucket.

Moreover, the movable wall can be used outside a fixed bucket wall, or as a stationary wall or together with one or more additional movable walls depending on the particular desired application.

These and other objectives and advantages will become readily apparent to those of ordinary skill in the art from the following description of a preferred and other embodiments of the invention and from the drawings in which:

DETAILED DESCRIPTION

Turning now to the drawings, there is shown therein a preferred embodiment of the invention, particular to orienting inserts in a conveyor bucket for combination with products to be loaded into a carton. It will be appreciated that the invention has many other applications wherein one or more items are oriented for combination with other items, and that the following is a detailed description of only one embodiment of the invention.

Figure 1:
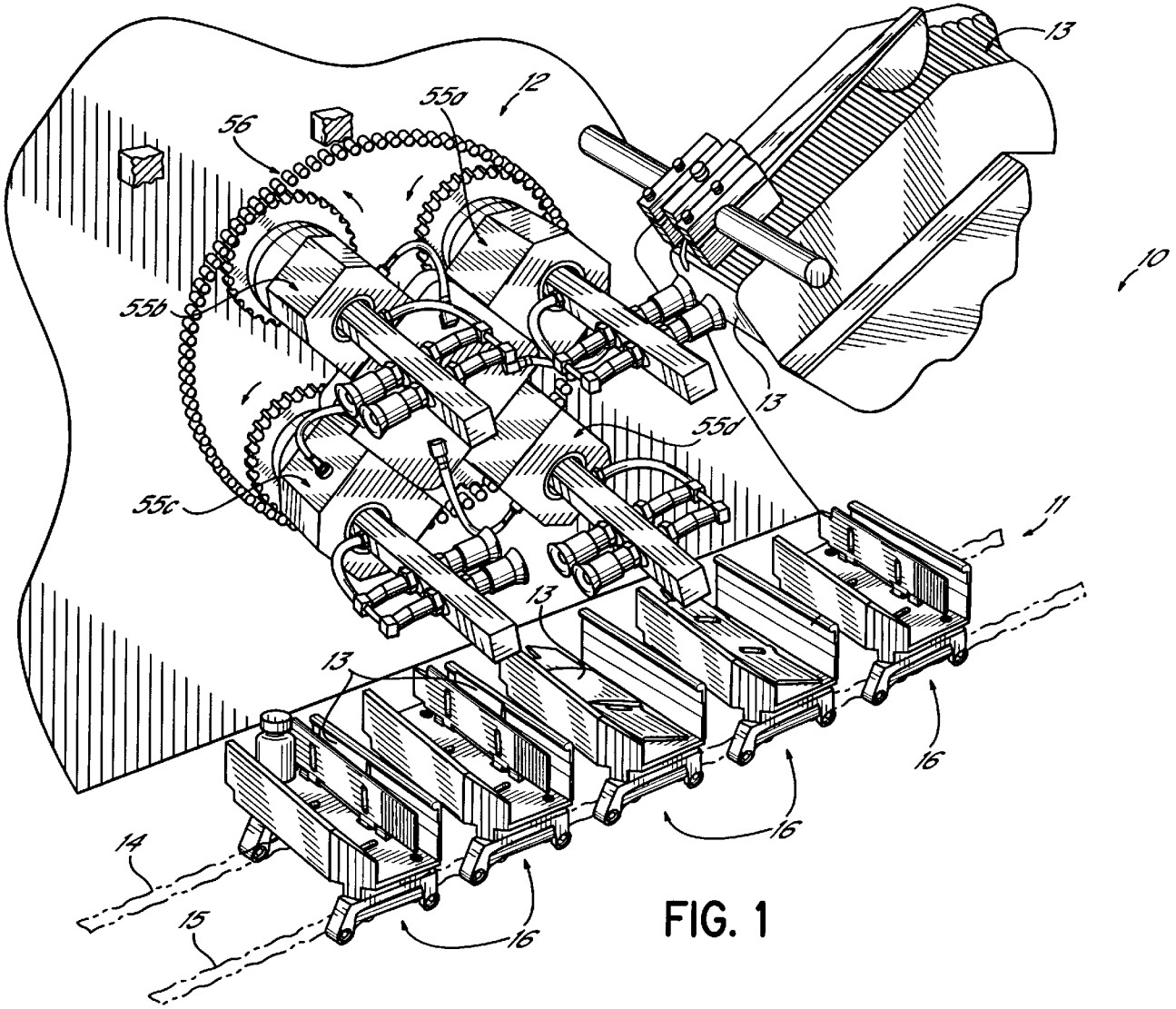
FIG. 1 is a perspective diagrammatic view of features of a preferred embodiment of the invention.

FIG. 1 is a perspective view of a preferred embodiment 10 of the invention showing a bucket conveyor 11 of the invention moving under a horizontal feeder 12 for depositing or introducing items such as inserts 13 to the conveyor 11.

Figure 2:
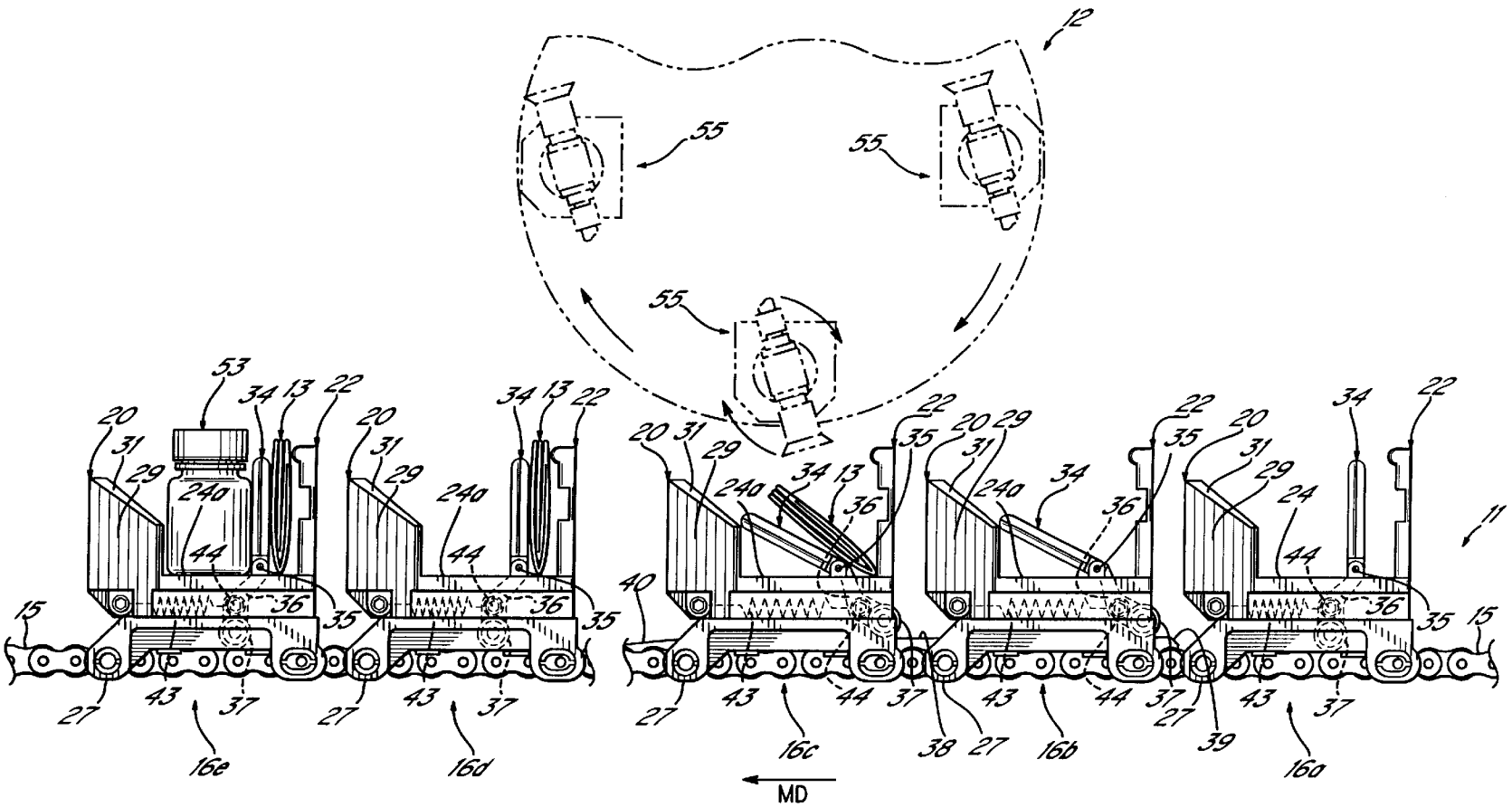
FIG. 2 is an elevational diagrammatic view of a preferred embodiment of the invention illustrating feeding and orientation of an insert in a bucket, combined with a product.
Figure 3:
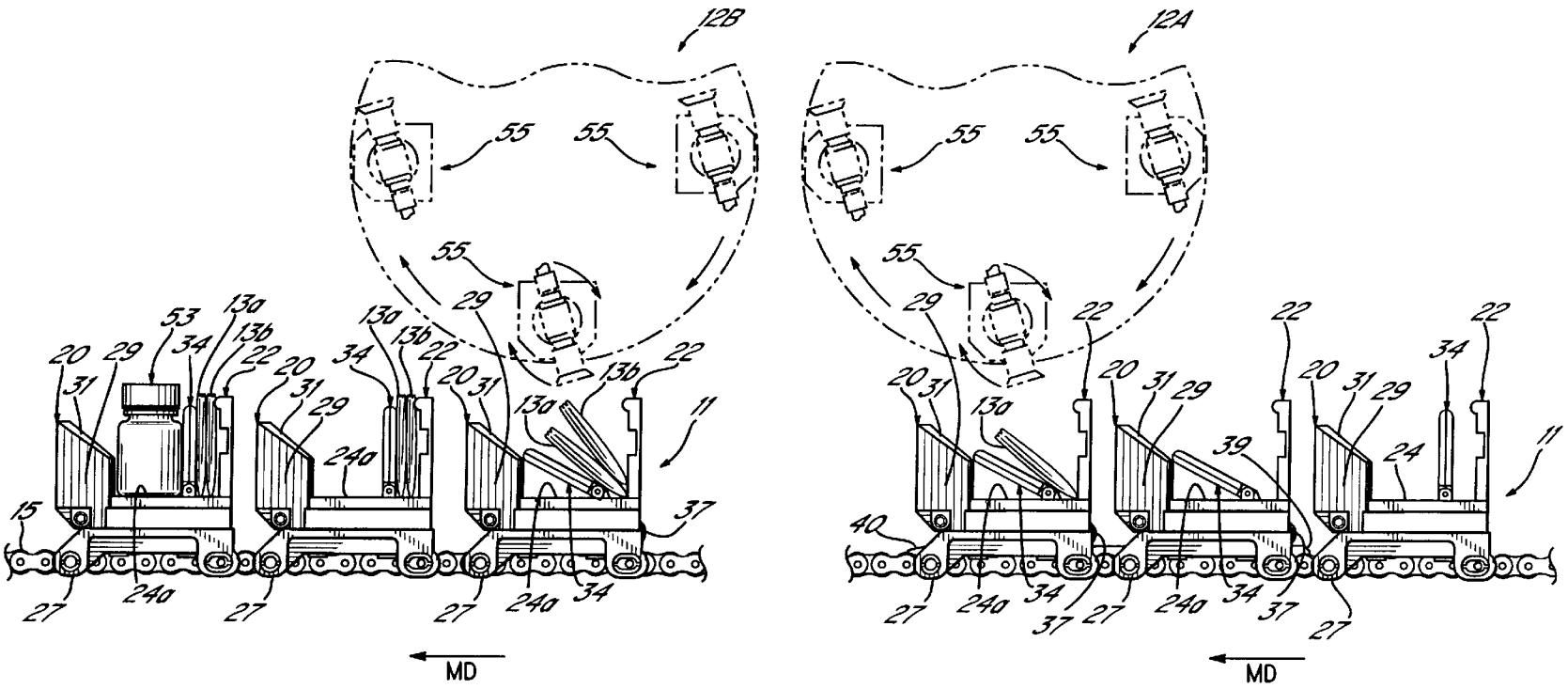
FIG. 3 is a view similar to FIG. 2 but illustrating two inserts fed into and oriented in a bucket and combined with a product.
Figure 4:
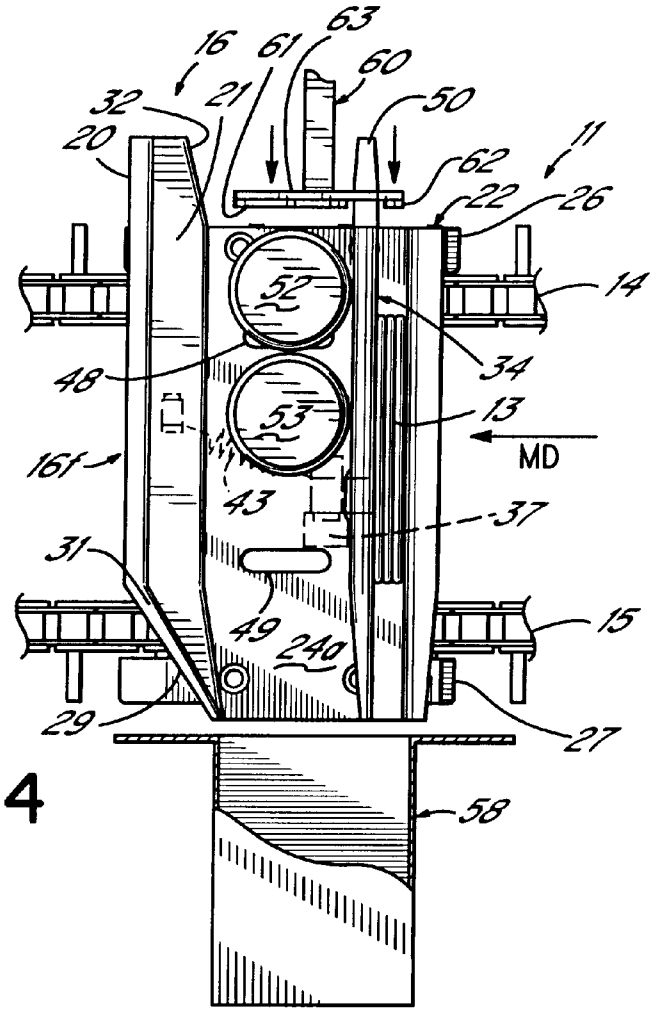
FIG. 4 is a top plan view illustrating a pusher for initial transfer of product and insert toward a carton.

Relevant components on conveyor 11 are perhaps best seen in FIGS. 2–4. Preferably the conveyor 11 includes two chains 14,15 carrying a plurality of buckets 16, according to the invention.

Figure 6:
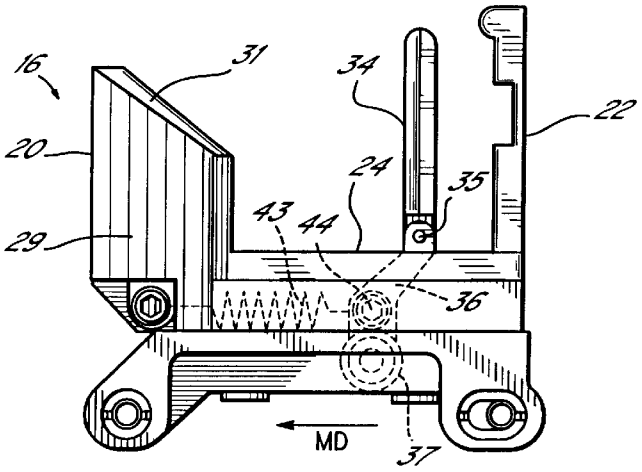
FIG. 6 is an elevational view of the bucket of FIG. 5 showing the movable wall in an upright position.
Figure 7:
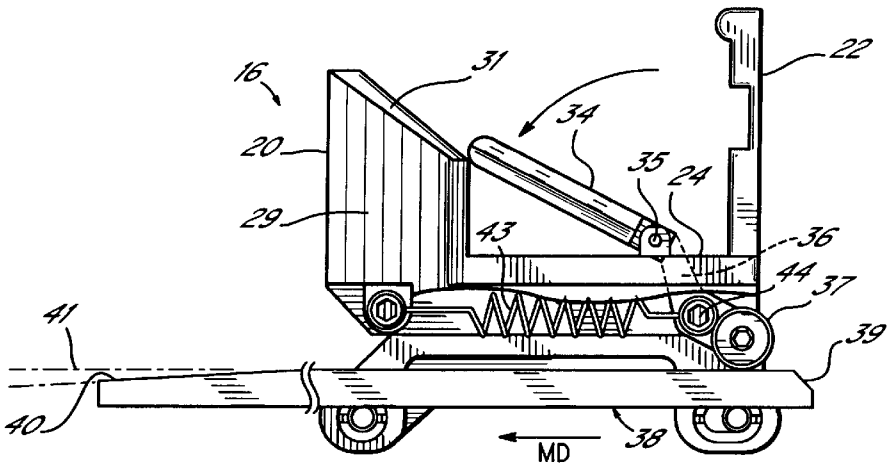
FIG. 7 is an elevational view similar to FIG. 6 but showing the movable wall in a declined position.
Figure 5:
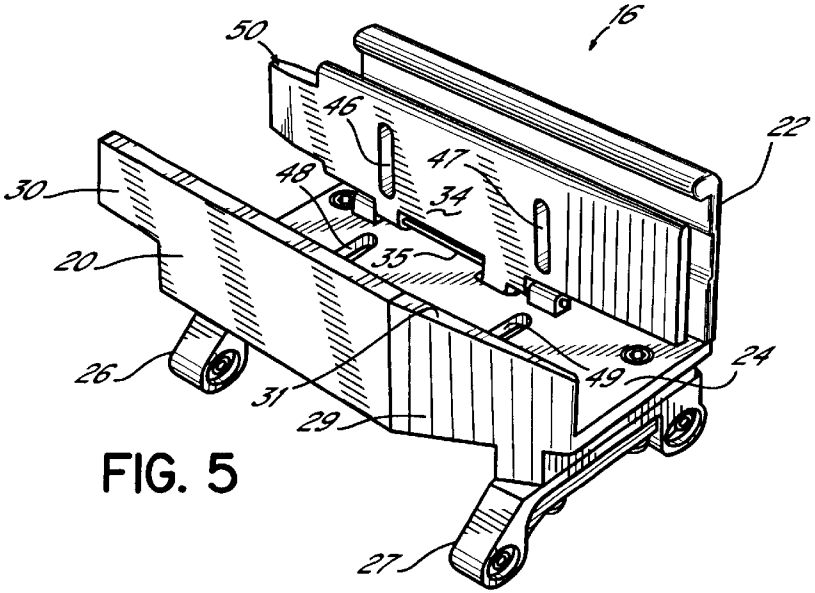
FIG. 5 is a perspective view of a bucket according to one embodiment of the invention.

Buckets 16 are perhaps best seen in FIGS. 5–7. The buckets can be made by any suitable process of any suitable material. Preferably, they are molded of any suitable synthetic material, not part of this invention. The buckets 16 as shown in FIGS. 5–7 have an upright leading or forward wall 20, an upright trailing or rearward wall 22 and a floor 24. Integrally molded or attached brackets 26, 27 depend from floor 24 for attachment of the bucket to conveyor chain 14, 15.

Figure 2A:
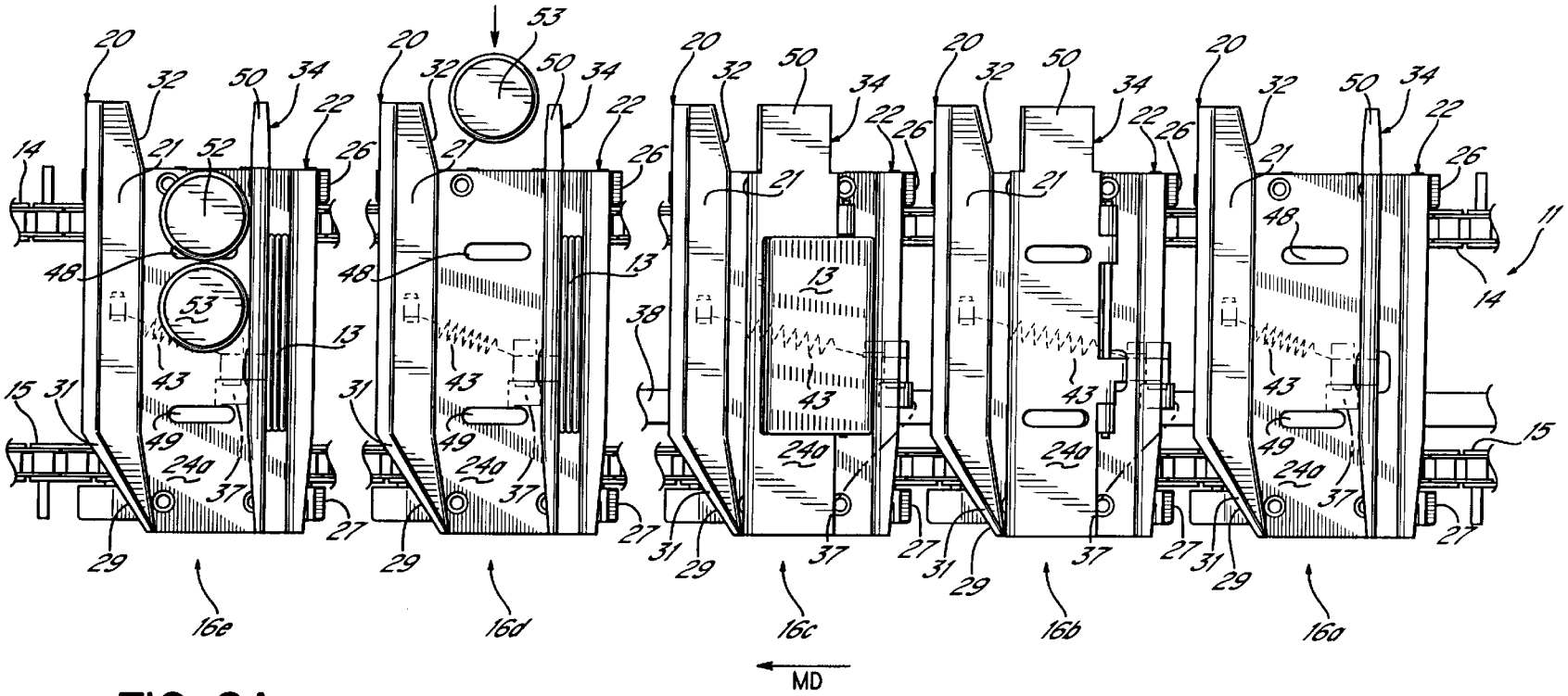
FIG. 2A is a top plan view of the invention as shown in FIG. 2 and showing a product also fed into a bucket.

Lead wall 20 has a tapered surface 29 on one end and an extended opposite end 30. Upper surface 31 declines downwardly on the top edge of surface 29. End 30 is provided with a tapered rear face 32 as best seen in FIG. 2A.

Further describing lead wall 20, it will be appreciated that the rear side of that wall comprises a step surface 21 (FIG. 2A) for receiving the upper edge of an item or insert when first deposited, if it is wide. Rear wall 22 and forward wall 20 are oriented upwardly from floor 24 and are relatively fixed parts of bucket 16.

A movable wall 34, also referred to as a movable member or lift member, is pivoted at 35 to bucket 16. A lever arm 36 is attached to wall 34 and depends downwardly therefrom on the other side of pivot 35. A cam follower or roller 37 is attached to the lower end of arm 36.

As best seen in FIG. 7, a cam 38 is disposed under the buckets 16 extending along in a machine direction, MD. Cam 38 has a tapered or inclined lead in cam surface 39, rather abrupt, and a gentler lead out cam surface 40 which declines at about 3 degrees from the horizontal or conveyor parallel run of conveyor 11.

A spring 43 is attached at one end to the bucket 16 and at another end to lever arm 36 at 44 beneath pivot 35. Spring 43 thus tends to pull wall 34 into an upright position (FIGS. 5, 6) while cam 38 causes wall 34 to pivot downwardly and then release when buckets 16 are over the cam 38 (see FIG. 7).

As shown in FIG. 5 for example, wall 34 is provided with two slots 46, 47 while floor 24 is provided with two slots 48, 49, indexed or aligned respectively with slots 46, 47. These are provided such that when wall 34 is declined downwardly, the slots in the wall are aligned with those in floor 24. Any sensing beam extends therethrough so as to not generate a false indication than an item is on the wall in this declined position.

Returning to the description of wall 34, it will be appreciated that the wall has an extended end 50, extending outwardly beyond floor 24. This end, when the wall 34 is in its upright position, is used to engage and help pick off a product for introduction into the bucket (FIG. 2A). Tapered rear surface 32 of lead wall 20 receives products or items 52, 53 for feeding into bucket 16. Products or items 52, 53 can be fed to the buckets 16 in any suitable fashion by any of suitable means.

Returning to FIG. 1, a plurality of buckets 16 are conveyed under a horizontal feeder 12. Feeder 12 can be any suitable feeder for introducing inserts 13 to buckets 16 in a first orientation or attitude which is generally horizontal, inclined, laid over from a more vertical or upright orientation. One such feeder 12 which has been found suitable is the fixed pin drive horizontal pick and place feeder model RPP-421 manufactured by the MGS Machine Corporation of Maple Grove, Minn. This feeder 12 is diagrammatically illustrated in FIG. 1 and has a plurality of rotatable suction cup assemblies 55*a*–55*d*, all mounted for rotation about an axis extended through a static circle of pins 56. As the assemblies 55 rotate, their engagement with the pins causes them to rotate, in a known manner, to pick off inserts 13 and place them in buckets 16, as illustrated.

Any insert feeder can be used but it is appreciated that it is desirable to use a horizontal feeder placing inserts 13 in buckets 16 in a generally horizontal or laid out orientation. As will be appreciated, it is not necessary to use a vertical feeder or vertical guides and pushers to orient the inserts 13 in an upright or vertical position.

Operation of one embodiment of the invention where one inset is combined with two products, for example, is illustrated in FIGS. 2 and 2A. First, the operation of the buckets 16 with movable wall 34 will be explained. Each bucket 16*a*–16*f* is like bucket 16, these additional letters being used for clarity to describe buckets in different positions.

As the buckets 16 move over the cam 38, the surface 38 (see FIG. 7) is engaged by roller or cam follower 37. The engagement quickly rotates and lowers wall 34 over the floor 24 of bucket 16 to at least a downwardly inclined or declined position as shown in bucket 16*b* (FIG. 2). As the follower 37 rides on cam 38, the wall 34 remains down, over floor 24, and particularly over area 24A of floor 24.

At this time, the bucket is conveyed under a discharge position of feeder 12, illustrated over bucket 16*c*, where it drops an insert 13, in a generally horizontal position, into bucket 16*c*. This drop can be accomplished whether the bucket is stopped, as in an intermittent operation, or is moving, as in a continuous operation. As shown, the insert 13 is thus dropped onto wall 34 in the bucket where it lays in a declined position on the wall and over floor 24.

Thereafter, the bucket 16*c* is conveyed in the machine direction MD and the follower 37 rolls down surface 40. Spring 43 pulls arm 36 to gently lift wall 34, and the insert 13 thereon toward, and in this case into, an upright, generally vertical attitude. This insert 13 is oriented, lifted, rotated or moved from a first to a second attitude, in the bucket.

After the insert 13 is lifted, as illustrated in bucket 16*d*, products 52, 53 are introduced into buckets (16*e*). The products 52, 53 reside proximate inserts 13 and on another side of wall 34 from the inserts. More particularly, products 52, 53 rest on an area 24*a* of floor 24 previously covered by wall 34 and insert 13 before the wall was moved.

Turning now to FIG. 4, it will be appreciated that bucket 16*f* has moved downstream in the direction MD to a position where items in the bucket, including products 52, 53 and insert 13 can be pushed into the open end of a carton 58. This is accomplished by an inverted U-shaped pusher 60 having two separate legs 61, 62 mounted on a cross member 63 secured to a push member 64. When this member moves transversely as illustrated in FIG. 4, leg 61 engages product 52 and leg 62 engages insert 13 to push them out of bucket 16f into carton 58. Legs 61, 62 depend down each side of wall 34 and so avoid it as the pusher 60 transfers the items into the carton. Of course, cartons are presented in indexed fashion alongside conveyor 11 in either continuous or intermittent motion as appropriate.

It will be appreciated that the buckets 16 present a wide target for the inserts, i.e. the front-to-back length of the buckets in the machine direction MD between walls 20, 22. This distance is illustrated at 66 in FIG. 2A. This is a relatively wide target compared to the mouth 67 of the slot between the erected wall 34 and the rear wall 22, for example, which illustrates the spacing of prior slots in buckets where all walls were fixed.

In addition, it will be appreciated that while buckets 16 are described with fixed forward and rearward walls, the movable wall 34 can be used with only one wall, or on a different side of a wall other than as shown.

Moreover, the movable wall may itself constitute a leading or a trailing wall of a bucket. Also, it may be useful according to the invention to provide a bucket where each wall is hinged or pivoted, thus the lead and trail walls as well can be movable to accommodate a desirable product orientation result.

It will also be appreciated that the conveyor on which the invention is used may be a bucket conveyor or some other conveyor not having buckets, but predetermined conveyed stations with which an item erecting movable member, such as wall 34, can be used.

Also, it should be appreciated that more than one movable wall 34 can be used in a single bucket or station for handling a variety or a various number of items in the bucket.

Turning now to FIG. 3, there is illustrated an alternate form of the invention wherein two items, such as inserts 13*a*, 13*b*, are fed to the buckets 16 before the movable wall 34 is lifted. In such a case, feeder 12A feeds an insert 13*a* into bucket 16*c* and onto wall 34, just as in the above embodiment. When bucket 16*c* moves downstream, it is loaded by feeder 12B with an insert 13*b* on top of interset 13*a*. Thus, two inserts are introduced onto wall 34 over floor area 24*a* as shown. Thereafter, the wall 34 is raised, erecting both inserts 13*a*, 13*b* into an upright attitude for pushing into a carton (as in FIG. 4).

In this regard, it will be appreciated that both feeders 12A, 12B are similar to feeder 12, each for feeding a horizontal insert into a bucket. Alternately, they could feed other items, products, related products, leaflets and the like, without departing from the scope of the invention. Also, the inserts 13A, 13B are fed generally in laid out or generally horizontal format and are then lifted, with product being placed on the bucket floor 24, in area 24*a*, which had been covered by the wall 34 and inserts 13.

As with the foregoing embodiments, such apparatus and process can accommodate either continuous or intermittent motion, with the added advantage of multiple item or insert introduction and later reorientation in the bucket.

Moreover, in all embodiments, the movable member can be used to orient either inserts, such as shown, or products themselves in a bucket. This is useful, among other applications, where the product is the insert, for example.

The invention is also useful, for example, in handling product pouches where one or more is fed to a bucket in an inclined position by a horizontal feeder and then raised into or toward an upright position by one or more movable members.

It will also be appreciated that the invention can be used to orient partitions in a bucket with the partitions being generally horizontally fed and then lifted to reside between products for insertion into a carton where product separate or intermediate product information is desired.

It will also be appreciated the invention is useful in erecting or lifting one or more inserts in an upright position on one conveyor and then feeding it or them in an upright attitude to a product bucket in a cartoner. Such an alternative embodiment could also be used in erecting a partition which is then introduced to a space in a separate product bucket of a cartoner, such as between two products or stacks of products in such a bucket, and from where the products and insert or inserts are pushed into a carton.

In addition, it will be appreciated that the invention can be used generally to erect or stand up an item in a bucket for further processing or packaging.

Finally, while a movable wall has been described above, that wall may merely comprise a movable member in the bucket which is moved by pivoting or moved rectilinearly or in some other fashion to erect items into an upright condition.

Accordingly, many further embodiments, applications and modifications of the invention will become readily apparent to those of ordinary skill in the art without departing from the scope of the invention and applicant intends to be bound only by the claims appended hereto.

We claim:

1. A method of combining an insert with an item for insertion with the item into a carton, said method comprising the steps of:

loading first inserts into a series of buckets movable in a machine direction;

lifting said inserts toward a vertical orientation in the buckets; and thereafter introducing at least one item into the buckets into which inserts have been loaded and in a position proximate the lifted inserts.

2. A method as in claim 1, wherein said loading step includes depositing said inserts in a substantially horizontal orientation onto movable lifters within the respective buckets and thereafter rotating said lifters to raise said inserts toward said vertical orientation.

3. A method as in claim 2, including the step of depressing said lifters in said buckets at a position prior to depositing said inserts thereon and thereafter rotating said lifters to raise said inserts.

4. A method as in claim 3 comprising the steps of continually urging said lifters toward a raised position and carrying said lifters downwardly for receiving said inserts.

5. A method as in claim 1, comprising the further step of loading second inserts into said series of buckets, together with said first inserts and thereafter lifting said first and second inserts toward said vertical orientation.

6. A method as in claim 1 including the further step of pushing said item and said insert transversely across and from said bucket into a carton.

7. A method of combining inserts with products for cartoning and comprising the steps of:

depositing an insert into a product bucket movable in a machine direction;

lifting said insert toward an upright orientation; and introducing a product into said bucket adjacent a lifted insert.

8. A method as in claim 7 wherein the depositing step includes depositing an insert onto a movable lifting wall in said bucket and thereafter rotating said wall toward an upright orientation and lifting said insert.

9. A method as in claim 8 wherein said insert is deposited on said wall in said bucket in a substantially horizontal orientation and is lifted by said wall to a substantially vertical orientation.

10. A method as in claim 8 including the step of depositing a second insert onto said lifting wall and thereafter rotating said wall and lifting said inserts.

11. A method as in claim 8 including the further step of introducing said product into said bucket on an area covered by said movable lifting wall before said wall is rotated.

12. A method of combining an insert with a product comprising the steps of:

loading an insert into a bucket between a first bucket wall and a movable second bucket wall;

moving said second wall to move said insert toward an upright orientation; and loading a product in said bucket on another side of said second bucket wall from said insert.

13. A method as in claim 12, wherein said product is loaded in said bucket on a surface covered by said movable second bucket wall prior to moving said second wall to move said insert.

14. A method of combining an insert with a product comprising the steps of:

loading an insert into a bucket between a first bucket wall and a movable member;

moving said movable member to move said insert toward an upright orientation; and loading a product in said bucket on another side of said movable member from said insert.

15. A method of combining two items comprising the steps of:

loading a first item in a first attitude into a bucket between a first bucket wall and a movable bucket wall;

moving the movable wall and reorienting the first item to a second attitude; and loading a second item into said bucket on another side of said movable wall from said first item.

16. A method of combining two proximate items on a conveyor station including reorienting one item from a first attitude to a second attitude comprising the steps of:

depositing a first item in a first attitude on a movable member mounted on said conveyor at said station;

moving said member from a first position to a second position to reorient said first item to a second attitude at said station; and introducing a second item to said station proximate said first item in said second attitude.

17. A method as in claim 16 including introducing said second item to an area in said station covered by said movable member in its said first position.

18. A method of orienting an item for insertion into a carton and comprising the steps of:

loading an item in a conveyor bucket in a first attitude;

rotating said item in said bucket into a second attitude; and thereafter introducing at least one further item into a position proximate the item in said second attitude.

19. A method of combining two items for cartoning and comprising the steps of:

introducing a first item into a bucket movable in a machine direction, said item being oriented in a first attitude;

lifting said first item into a second attitude; and introducing another item into said bucket proximate said first item.

20. A method of orienting an item on a conveyor comprising the steps of:

depositing an item on a movable member on said conveyor;

said item being deposited in a first attitude;

moving said member and lifting said item to a second, more upright attitude for combination with another item in a product bucket.

* * * * *